US009016350B2

(12) United States Patent
Zhu

(10) Patent No.: US 9,016,350 B2
(45) Date of Patent: Apr. 28, 2015

(54) CLEAN METAL INGOT MOLD

(75) Inventor: Shucheng Zhu, Henan (CN)

(73) Assignee: Nanyang Xingzhi Patent Technology Service Co., Ltd. (CN)

( * ) Notice: Subject to any disclaimer, the term of this patent is extended or adjusted under 35 U.S.C. 154(b) by 17 days.

(21) Appl. No.: 13/876,933

(22) PCT Filed: Nov. 23, 2010

(86) PCT No.: PCT/CN2010/078979

§ 371 (c)(1),
(2), (4) Date: Apr. 29, 2013

(87) PCT Pub. No.: WO2012/040963

PCT Pub. Date: Apr. 5, 2012

(65) Prior Publication Data

US 2013/0213598 A1 Aug. 22, 2013

(30) Foreign Application Priority Data

Sep. 30, 2010 (CN) ..... 2010 1 0297870

(51) Int. Cl.
*B22D 41/005* (2006.01)
*B22D 11/00* (2006.01)
*B22D 7/06* (2006.01)

(52) U.S. Cl.
CPC . *B22D 7/06* (2013.01); *B22D 7/064* (2013.01)

(58) Field of Classification Search
CPC ..... B22D 7/06; B22D 7/064
USPC ..... 164/122, 122.1, 125–128, 348, 421, 164/464, 271, 338.1
See application file for complete search history.

(56) References Cited

U.S. PATENT DOCUMENTS 4,759,399 A * 7/1988 Saito et al. ..... 164/126
5,589,650 A * 12/1996 Flemming et al. ..... 73/866
2003/0145977 A1* 8/2003 Smashey ..... 164/462

FOREIGN PATENT DOCUMENTS

CN 101249550 A 8/2008
CN 101406938 A 4/2009
CN 101543877 A 9/2009
CN 201423430 Y 3/2010
SU 933195 A2 6/1982
SU 973220 A1 11/1982

OTHER PUBLICATIONS

English Machine Translation of CN 101406938.*
English Machine Translation of CN 101406938, Published Apr. 15, 2009.*
International Search Report for PCT/CN2010/078979, mail date Jul. 7, 2011.

* cited by examiner

*Primary Examiner* — Keith Walker
*Assistant Examiner* — Steven Ha
(74) *Attorney, Agent, or Firm* — Rossi, Kimms & McDowell LLP

(57) ABSTRACT

A clean metal ingot mold comprises an ingot mold body and an insulating riser arranged on the ingot mold body. The bottom mold plate of the ingot mold is provided with at least a ridge connected thereto. The region having a V-shape containing impurities produced during the crystallization process of the liquid metal moves upwards because of the ridge, and then the impurities depart from the center of the cast ingot and the impurities are more centralized. A water-cooling device is arranged in the ridge to allow the temperature of the metal in the ingot mold to decrease rapidly, and the crystallization process of the metal to be rapid.

10 Claims, 2 Drawing Sheets

CLEAN METAL INGOT MOLD

This application is a U.S. National Phase Application of PCT International Application PCT/CN2010/078979, filed on Nov. 23, 2010, which is based on and claims priority from CN 201010297870.1, filed on Sep. 30, 2010, the contents of which is incorporated in its entirety by reference.

TECHNICAL FIELD

The present invention relates to a clean metal ingot mold which belongs to the field of metallurgical casting equipment technology.

BACKGROUND OF THE INVENTION

It is well known in the art that a region having a V-shape section enriched in segregates and inclusions is formed after the completion of crystallization of the liquid metal. The region moves upwards because of the ridge, and then the impurities depart from the centre of the cast ingot and are more centralized.

What's more, the metal bound with the segregates and inclusions can not be easily separated from impurities, which will affect the improvement of the yield of metal. Currently, most of metal ingots in the world are still casted in this way, and thus a lot of metal is not recovered with a high quality to be used effectively and fully, which cause a lot of energy wasting.

In order to get clean metal, a secondary melting refining procedure, such as electroslag remelting is needed. This causes a great wasting of manpower and resource. Additionally, a great pressure is also imposed on the environment. This does not meet the requirements of energy saving and environmentally friendly development, which is the great loss of the metal smelting industry.

In the process of the secondary melting refining by electroslag remelting, a lot of electric power is required to remelt the ingot. What is worse, this is also a restriction to the large-scale industrial production, and the residue compound contains a lot of calcium fluoride which is pollutant to the environment, and thus a de-dust and a de-fluorine device are have to be arranged. In addition, because the efficiency is particularly low, especially the electric arc could seriously damage the crystallizer, a crystallizer mold in the manner of electroslag furnace remelting can only refine scores of furnace of steel, which increases the cost of production.

SUMMARY OF THE INVENTION

The present invention provides a clean ingot mold having a long service life, which can reduce emissions of pollutants and improve production efficiency. Using this equipment, molten steel smelted by the converter, electric furnace, LF furnace or VD furnace can be poured directly into such device. After a simple process, a clean steel ingot can be obtained. In this way, it can significantly reduce energy consumption and increase production efficiency, as well as lower the production costs.

A clean metal ingot mold includes an ingot mold body and a insulating riser arranged on the ingot mold body. The bottom mold plate of the ingot mold is provided with at least a ridge thereto.

One of the ridges was disposed in the bottom mold plate along the midline, while the others were substantially vertical to the basis ridge.

A water-cooled device is provided in the ridge.

An insulated heating and heat preservation plate is arranged on the ridges, and the ridges and heat preservation plate divides the space of the inner cavity of the ingot mold into several separated spaces.

The insulated heating and heat preservation device is a high temperature resistant plate.

A strong heating element is set within the high temperature resistant plate.

A casting system is disposed on the ingot mold body.

The ingot mold body is a water-cooled ingot mold.

The ingot mold body is an ordinary ingot mold.

A clamping groove is disposed on the inner wall of the ingot mold body and is used in conjunction with the insulated heating and heat preservation device. The two ends of the insulated heating and heat preservation device are disposed in the groove. An upper groove is provided on the inner wall of insulating riser, and the upper groove is clamped to the clamping portion of the insulated heating and heat preservation device.

In the present invention, since the bottom mold plate of the ingot mold is provided with at least one ridge connected with the bottom mold plate, the ridges can move the V-shape impurity-containing region produced during the crystallization process of the liquid metal to the heat preservation dead head region, which can make the impurity more intensively deviate from the ingot center, make it easy for post-processing of impurities and thus achieve clean metal.

The water-cooled device arranged in the ridges allow metal in the ingot mold to cool and crystallize rapidly, and play an important role in the directional solidification of the liquid metal. One basis ridge is set on the bottom mold plate along midline, while the rest of the ridges are vertical to the basis ridge. An isolated heating and heat preservation plate is arranged on the ridge, and the inner space of the ingot mold body is divided into a plurality of separate body cavity unit by the ridge and isolated heating and heat preservation plate. The mold cavity units in the ingot mold body are therefore distributed in two rows.

During the solidification and crystallization of liquid metal, each separate mold cavity unit has a solidification starting surface with rapid outward thermal conductivity, i.e. the surface in contact with the circumferential mold plate, and a solidification ending surface in contact with the insulated heating and heat preservation device. The liquid metal in contact with water-cooled mold plate or other mold plates solidifies rapidly, which slowly crystallized towards the insulated heating and heat preservation device, and then drive the inclusions and segregates in the liquid metal towards the uncrystallized direction during the crystallizing process. The portion close to the insulated heating and heat preservation device solidifies at latest because of being away from lower temperature. After the directional solidification in the liquid metal, most of the inclusions and segregations enrich in the portion that contacts the insulated heating and heat preservation device, which makes it very easy to use flame or other processing methods to remove the enriched alloyed segregates and inclusions, thus could transfer and remove the segregates and inclusions in the ingots, thereby realizing the purpose of ingot purification. Compared with existing electroslag remelting techniques, the present invention could achieve the purification inside the metal without secondary melting, which can then save large amount of energy. In the mean time, this avoids the damage of hydrogen white point to the ingot caused by electroslag remelting, with production efficiency being significantly increased, and the cost being significantly decreased.

Strong heat generating component provided in said insulated heating and heat preservation device heats up just before the liquid metal being poured into the ingot mold, in order to avoid the heat of molten metal being absorbed. During the process of directional solidification of liquid metal, the presence of insulated heating and heat preservation device can ensure the portion contacted thereto at a high temperature state, and most of the inclusions and segregates within the liquid metal was more concentrated in the region in contact with insulated heating and heat preservation device after directional solidification of the liquid metal, making it easier to be handled.

As required, the present invention can set multiple cavity units in two rows, and clean runners once in an ingot casting, and can achieve multi-block or even dozens of blocks of metal ingots clean crystallization, which greatly improves work efficiency and reduce production costs.

BRIEF DESCRIPTION OF THE DRAWINGS

In the following, the present invention will be further described in conjunction with the accompanying drawings.

DESCRIPTION OF THE PREFERRED EMBODIMENT

Embodiment 1

Figure 1:
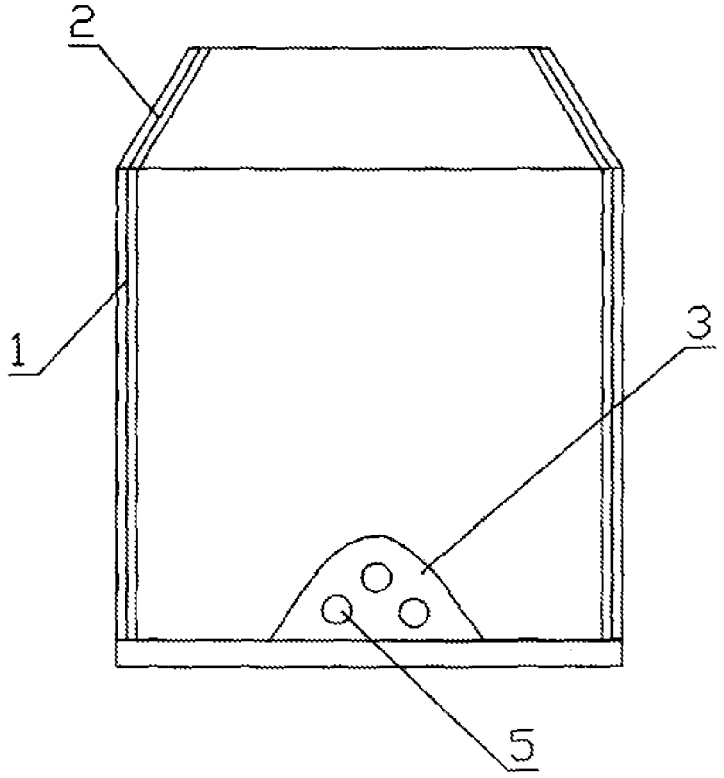
FIG. 1 is a schematic structural view according to embodiment 1 of the invention.

As shown in FIG. 1, a clean metal ingot mold comprises a ingot mold body 1 and a insulating riser 2 arranged on the ingot mold body 1. The bottom mold plate of the ingot mold is provided with a ridge connected therewith. A basis ridge is arranged along the midline of the bottom mold plate. The ridge 3 is provided with a water-cooled device 5 for cooling. The circulating water passes through the ridge 3. The ingot mold body is a water-cooled ingot mold.

Embodiment 2

Figure 2:
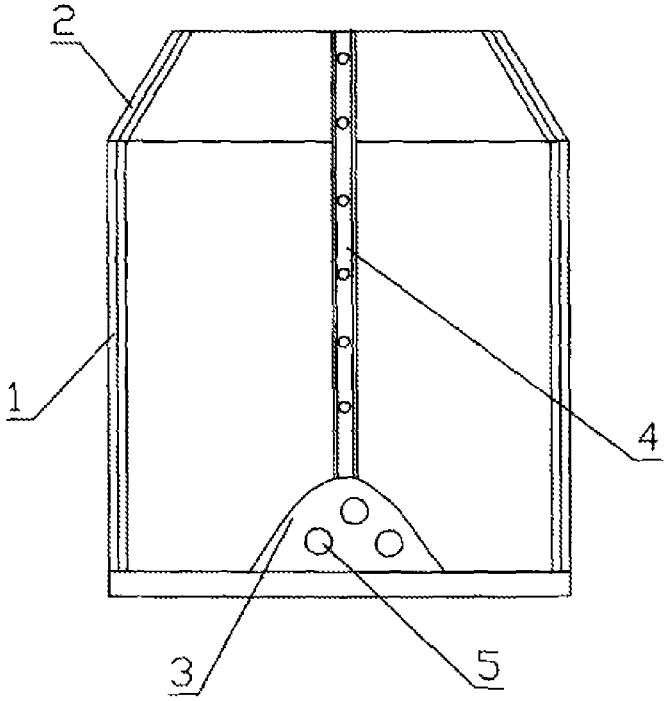
FIG. 2 is a plan view of the FIG. 1.

As shown in FIG. 2, a clean metal ingot mold comprises a ingot mold body 1 and a insulating riser 2 arranged on the ingot mold body 1. The bottom mold plate of the ingot mold is provided with a ridge connected therewith. A basis ridge is arranged along the midline of the bottom mold plate. The ridge 3 is provided with a water-cooled device 5 for cooling. An isolated heating and heat preservation plate 4 is arranged on the ridge 3, and the inner space of the ingot mold body is divided into two separate body cavity units by the ridge 3 and isolated heating and heat preservation plate 4. The isolated heating and heat preservation plate is a high-temperature resistant plate. A strong heating element is set within the high temperature resistant plate. The ingot mold body is a water-cooled ingot mold. A clamping groove is disposed on the inner wall of the ingot mold body and is used in conjunction with the insulated heating and heat preservation device, the two ends of the insulated heating and heat preservation device are disposed in the groove, a upper groove is provided on the inner wall of insulating riser, and the upper groove is clamped to the clamping portion of the insulated heating and heat preservation device.

Embodiment 3

Figure 3:
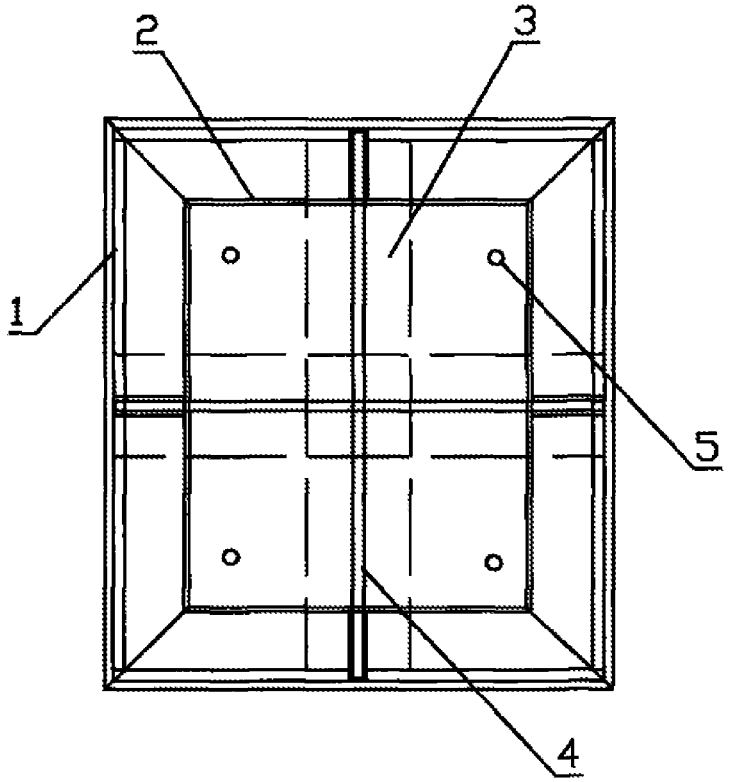
FIG. 3 is a schematic block diagram according to embodiment 2 of the present invention.

As shown in FIG. 3, a clean metal ingot mold comprises a ingot mold body 1 and a insulating riser 2 arranged on the ingot mold body 1. The bottom mold plate of the ingot mold is provided with two ridges connected therewith. The two ridges are arranged to be horizontally and vertically crossed. The ridge 3 is provided with a water-cooled device 5. An isolated heating and heat preservation plate 4 is arranged on the ridge 3, and the inner space of the ingot mold body is divided into four separate body cavity units by the ridge 3 and isolated heating and heat preservation plate 4. The isolated heating and heat preservation plate is a high-temperature resistant plate. A strong heating element is set within the high temperature resistant plate. A casting system is disposed on the ingot mold body. An ingate 5 is arranged on the bottom mold plates center in four separate cavity units. The ingot mold body is an ordinary ingot mold. A clamping groove is disposed on the inner wall of the ingot mold body and is used in conjunction with the insulated heating and heat preservation device, the two ends of the insulated heating and heat preservation device are disposed in the groove, a upper groove is provided on the inner wall of insulating riser, and the upper groove is clamped to the clamping portion of the insulated heating and heat preservation device.

Embodiment 4

Figure 4:
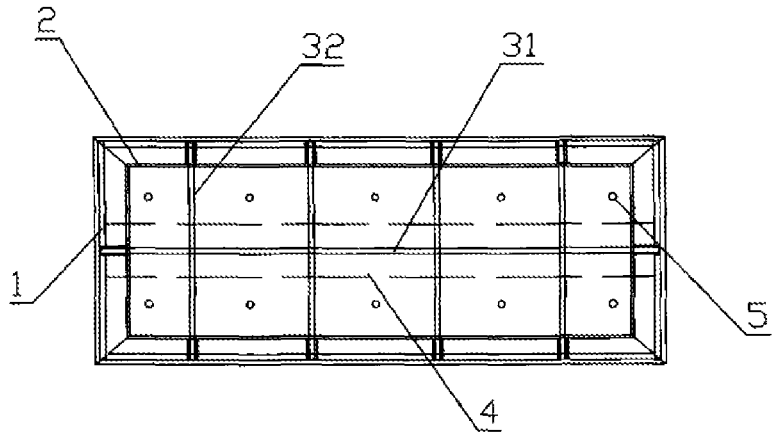
FIG. 4 is a schematic diagram of the portion of ingot mold body according to a embodiment 4 of the present invention.

As shown in FIG. 4, a clean metal ingot mold comprises a ingot mold body 1 and a insulating riser 2 arranged on the ingot mold body 1. One basis ridge 31 is set on the bottom mold plate, while the rest of the ridges 32 are vertical to the basis ridge 31.

The ridge is provided with a water-cooled device 5. An isolated heating and heat preservation plate 4 is arranged on the basis ridge 31 and four ridges 32, and the inner space of the ingot mold body is divided into ten separate body cavity units by the ridge and isolated heating and heat preservation plate 4. The isolated heating and heat preservation plate is a high-temperature resistant plate. A strong heating element is set within the high temperature resistant plate. A casting system is disposed on the ingot mold body. An ingate 5 is arranged on the bottom mold plate center in ten separate cavity units. The ingot mold body is a water-cooled ingot mold. A clamping groove is disposed on the inner wall of the ingot mold body and is used in conjunction with the insulated heating and heat preservation device, the two ends of the insulated heating and heat preservation device are disposed in the groove, a upper groove is provided on the inner wall of insulating riser, and the upper groove is clamped to the clamping portion of the insulated heating and heat preservation device.

The scope of protection of the present invention is not limited to the above embodiment, as long as the ingot mold bottom mold plate provided with at least one ridge connected with the bottom mold plate, which all belongs within the scope of protection of the present invention. Further, the present invention is also not limited to the ordinary ingot mold, a water-cooled ingot mold, but also suitable ingot mold in the mold.

What is claimed is:

1. A clean metal ingot mold comprising:

an ingot mold body;

an insulating riser arranged on the ingot mold body, a bottom mold plate connected to the ingot mold body;

at least a ridge connected to the bottom mold plate and within the ingot mold body; and a water-cooled device arranged within the ridge.

2. A clean metal ingot mold of claim 1, wherein one of the ridges is a basis ridge and is arranged along the midline of the bottom mold plate, and the rest of the ridges are vertical to the basis ridge.

3. A clean metal ingot mold of claim 1, wherein an isolated heating and heat preservation plate is arranged on the ridge, and the inner space of the ingot mold body is divided into a plurality of separate body cavity units by the ridge and isolated heating and heat preservation plate.

4. A clean metal ingot mold of claim 3, wherein the isolated heating and heat preservation plate is a heat resistant plate.

5. A clean metal ingot mold of claim 4, wherein a heating element is arranged within the heat resistant plate.

6. A clean metal ingot mold of claim 3, wherein a casting system is arranged on the ingot mold body.

7. A clean metal ingot mold of claim 3, wherein the ingot mold body is a water-cooled ingot mold.

8. A clean metal ingot mold of claim 3, wherein the ingot mold body is an ordinary ingot mold.

9. A clean metal ingot mold of claim 3, wherein a clamping groove is disposed on the inner wall of the ingot mold body and is used in conjunction with the insulated heating and heat preservation device, the two ends of the insulated heating and heat preservation device are disposed in the groove, an upper groove is provided on the inner wall of insulating riser, and the upper groove is clamped to the clamping portion of the insulated heating and heat preservation device.

10. A clean metal ingot mold of claim 2, wherein an isolated heating and heat preservation plate is arranged on the ridge, and the inner space of the ingot mold body is divided into a plurality of separate body cavity units by the ridge and isolated heating and heat preservation plate.

* * * * *